US009775208B2

(12) United States Patent
Louvel

(10) Patent No.: US 9,775,208 B2
(45) Date of Patent: Sep. 26, 2017

(54) LED CURRENT BALANCING CIRCUIT AND METHOD THEREFOR

(71) Applicant: SEMICONDUCTOR COMPONENTS INDUSTRIES, LLC, Phoenix, AZ (US)

(72) Inventor: Jean-Paul Louvel, Colomiers (FR)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 15/175,307

(22) Filed: Jun. 7, 2016

(65) Prior Publication Data

US 2016/0381752 A1 Dec. 29, 2016

Related U.S. Application Data

(60) Provisional application No. 62/183,884, filed on Jun. 24, 2015.

(51) Int. Cl.
*H05B 37/02* (2006.01)
*H05B 33/08* (2006.01)

(52) U.S. Cl.
CPC ..... *H05B 33/0845* (2013.01); *H05B 33/083* (2013.01); *H05B 33/089* (2013.01); *H05B 33/0809* (2013.01)

(58) Field of Classification Search
CPC ..... H05B 33/0827; H05B 33/0815; H05B 33/0851; H05B 33/0812; H05B 33/083; H05B 33/0845; H05B 33/089; H05B 33/0809
USPC ..... 315/185 R
See application file for complete search history.

(56) References Cited

U.S. PATENT DOCUMENTS

| | | | | |
|---|---|---|---|---|
| 8,253,342 | B2 * | 8/2012 | Ku | H05B 33/0818 315/185 R |
| 8,674,621 | B2 * | 3/2014 | Ge | H05B 33/0812 315/209 R |
| 9,131,572 | B2 | 9/2015 | Laulanet et al. | |
| 2009/0167197 | A1 * | 7/2009 | Wang | H05B 33/0815 315/185 R |
| 2011/0068700 | A1 * | 3/2011 | Fan | H05B 33/0818 315/185 R |
| 2011/0254456 | A1 | 10/2011 | Ko | |
| 2012/0268011 | A1 * | 10/2012 | Shiu | H05B 33/0827 315/121 |
| 2012/0306387 | A1 | 12/2012 | Ferguson | |
| 2013/0249422 | A1 | 9/2013 | Kerstens et al. | |
| 2014/0062314 | A1 | 3/2014 | Moskowitz | |
| 2015/0137689 | A1 * | 5/2015 | Hu | H05B 33/0824 315/192 |

(Continued)

OTHER PUBLICATIONS

ON Semiconductor, "Dimmable Quasi-Resonant Primary Side Current-Mode Controller for LED TV Backlight," NCP1370 Product Review, Feb. 2016—Rev. P1, 19 pp.

(Continued)

*Primary Examiner* — Don Le
(74) *Attorney, Agent, or Firm* — Robert F. Hightower

(57) ABSTRACT

In one embodiment, and LED control circuit may be configured to monitor the value of currents in two or more strings of series connected LEDs, and to adjust the currents to be substantially equal to each other.

17 Claims, 6 Drawing Sheets

(56) References Cited

U.S. PATENT DOCUMENTS

2015/0237691 A1* 8/2015 Yang ..... H05B 33/0812
315/297

OTHER PUBLICATIONS

STMicroelectronics, "LED balancing circuits," TN0026 Technical note, Apr. 2007, Rev. 2, 9 pp.

* cited by examiner

LED CURRENT BALANCING CIRCUIT AND METHOD THEREFOR

PRIORITY CLAIM TO PRIOR PROVISIONAL FILING

This application claims priority to prior filed Provisional Application No. 62/183,884 entitled "CURRENT BALANCING FOR LIGHT EMITTING DIODES" filed on Jun. 25, 2015, and having common inventor Jean-Paul Louvel, which is hereby incorporated herein by reference.

BACKGROUND OF THE INVENTION

The present invention relates, in general, to electronics, and more particularly, to semiconductors, structures thereof, and methods of forming semiconductor devices.

In the past, the electronics industry utilized various methods and circuits to control the amount of current through multiple strings of series connected light emitting diodes (LEDs). These strings of LEDs can be used in a variety of applications, such as for example, backlighting of displays such as televisions or computer displays, for streetlights, and for other applications including high-power industrial applications. Some of the prior methods and circuits utilized a series switch to switch the current off in one string of LEDs if there was an open circuit in the string. Other prior methods and circuits may have terminate current in the strings in response to an overpower condition in the strings. However, the prior methods and circuits often did not accurately balance the currents in the parallel strings of series connected LEDs. Additionally, some of the prior circuits did not accurately control the value of the current through the LEDs strings.

Accordingly, it is desirable to have a method and circuit that more accurately controls the value of the current through the LEDs strings.

Figure 1:
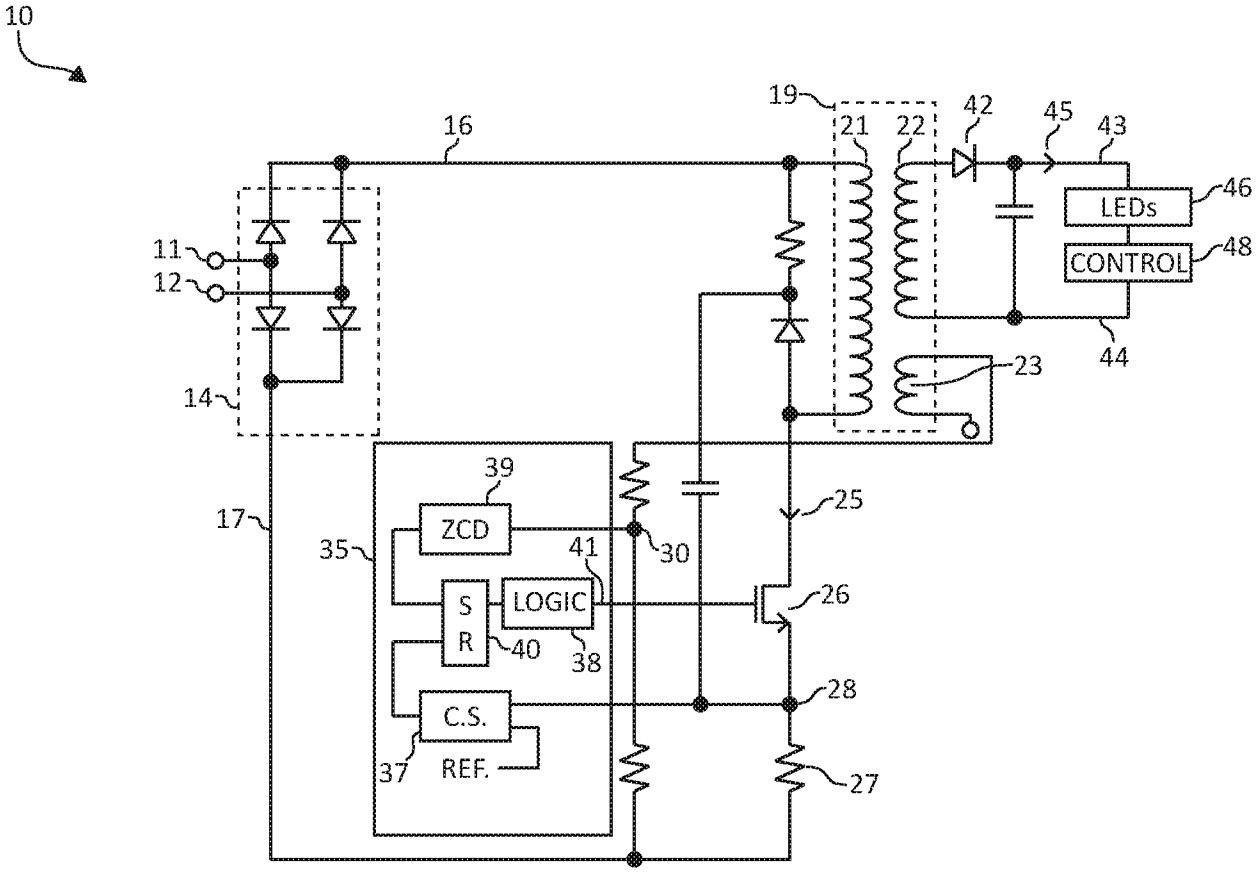
FIG. 1 schematically illustrates an example of an embodiment of an LED control system in accordance with the present invention.

For simplicity and clarity of the illustration(s), elements in the figures are not necessarily to scale, some of the elements may be exaggerated for illustrative purposes, and the same reference numbers in different figures denote the same elements, unless stated otherwise. Additionally, descriptions and details of well-known steps and elements may be omitted for simplicity of the description. As used herein current carrying element or current carrying electrode means an element of a device that carries current through the device such as a source or a drain of an MOS transistor or an emitter or a collector of a bipolar transistor or a cathode or anode of a diode, and a control element or control electrode means an element of the device that controls current through the device such as a gate of an MOS transistor or a base of a bipolar transistor. Additionally, one current carrying element may carry current in one direction through a device, such as carry current entering the device, and a second current carrying element may carry current in an opposite direction through the device, such as carry current leaving the device. Although the devices may be explained herein as certain N-channel or P-channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, that conductivity type does not refer to the doping concentration but the doping type, such as P-type or N-type. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten percent (10%) (and up to twenty percent (20%) for semiconductor doping concentrations) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure or characteristic described in connection with the embodiment is included in at least one embodiment of the present invention. Thus, appearances of the phrases "in one embodiment" or "in an embodiment"

in various places throughout this specification are not necessarily all referring to the same embodiment, but in some cases it may. Furthermore, the particular features, structures or characteristics may be combined in any suitable manner, as would be apparent to one of ordinary skill in the art, in one or more embodiments. For clarity of the drawings, doped regions of device structures are illustrated as having generally straight line edges and precise angular corners. However, those skilled in the art understand that due to the diffusion and activation of dopants the edges of doped regions generally may not be straight lines and the corners may not be precise angles.

In addition, the description illustrates a cellular design (where the body regions are a plurality of cellular regions) instead of a single body design (where the body region is comprised of a single region formed in an elongated pattern, typically in a serpentine pattern). However, it is intended that the description is applicable to both a cellular implementation and a single base implementation.

DETAILED DESCRIPTION OF THE DRAWINGS

FIG. 1 schematically illustrates an example of an embodiment of an LED control system 10 that is configured to accurately control the current through multiple strings of series connected LEDs. System 10 may include a transformer 19 that may have a primary winding 21 and a secondary winding 22. System 10 may be configured to control a primary current 25 through winding 21 on the primary side of system 10 in order to regulate a secondary or load current 45 through winding 22, on a secondary side of system 10, to a substantially constant value. The secondary side of system 10 may include a common return 44 and an output 43 that receives load current 45. Current 45 may be received by a load that includes one or more strings of series connected LEDs 46 and a control circuit 48. Control circuit 48 may be configured to control the current through LEDs 46 without affecting the value or controlling the value of current 45.

A primary side of system 10 may include a rectifier 14 that is configured to receive an AC input signal on inputs 11 and 12, such as an AC input from a mains circuit, and form a rectified a.c. signal between a voltage input 16 and a common return 17.

The primary side may have an embodiment that may include a switching power supply control circuit 35 that may be configured to control a power transistor 26 to regulate the value of current 45 to a substantially constant value. For this example embodiment, controller 35 is illustrated as a quasi-resonant flyback control system, however, those skilled in the art will appreciate that any type of power supply controller and power switch configuration may be utilized as long as the configuration regulates current 45 to a substantially constant value. The example embodiment of controller 35 may include a current sense circuit 37 that senses a value of primary current 25 and responsively disables switch 26 in response to a desired peak value of current 25. Circuit 35 may also include a zero crossing detection (ZCD) circuit 39 that detects when secondary winding 22 has been discharged and responsively causes switch 26 to be enabled. Transformer 19 may also include an auxiliary winding 23 that may assist in providing a signal that indicates the end of conduction in secondary side rectifier 42 connected to winding 22. One example of a controller similar to the example embodiment of controller 35 is referred to as an NCP1370 available from Semiconductor Industries, LLC (DBA ON Semiconductor) which has an office at 5005 E. McDowell road in Phoenix, Ariz.

Some embodiments of controller 35 may include a secondary side status input 36 that may be configured to receive a status signal that may be representative of the status of control circuit 48. Controller 35 may also have an embodiment that includes some control logic or a circuit that receives the status signal and use it to assist in controlling transistors 26.

Figure 2:
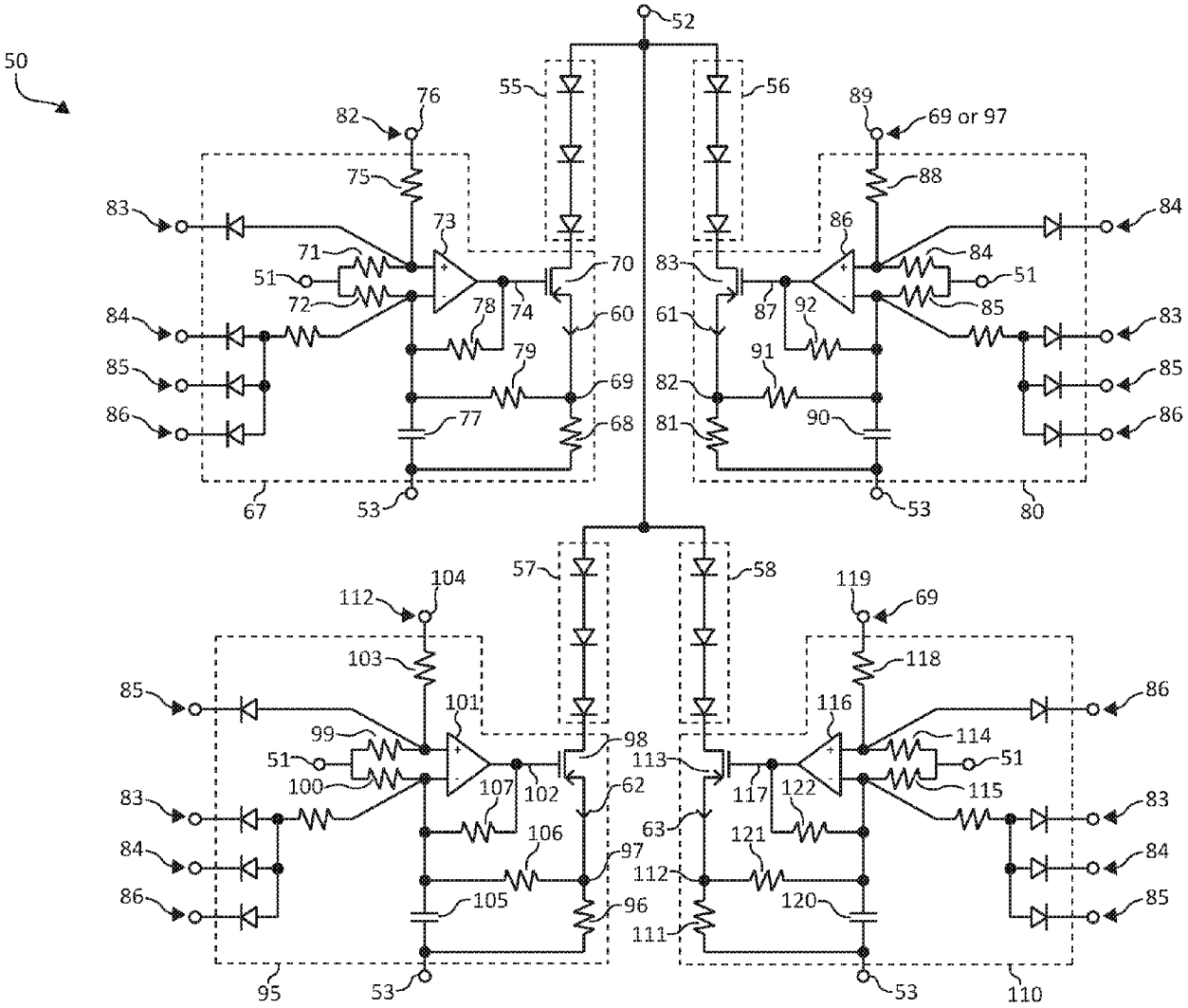
FIG. 2 schematically illustrates an example of an embodiment of an LED control circuit that may be an alternate embodiment of the LED control system of FIG. 1 in accordance with the present invention.

FIG. 2 schematically illustrates an example of an embodiment of an LED control circuit 50 that may be an alternate embodiment of control circuit 48 illustrated in FIG. 1. In one embodiment, LED control circuit 50 may include a control circuit 67, a control circuit 80, a control circuit 95, and a control circuit 110. An embodiment of LEDs 48 of FIG. 1 may include multiple strings of series connected LEDs wherein the multiple strings are connected together in parallel. In an embodiment, the multiple strings of LEDs may include a first string of series connected LEDs or string 55, a second string of series connected LEDs or string 56, a third string of series connected LEDs or string 57, and a fourth string of series connected LEDs or string 58. Each of strings 55, 56, 57, and 58 may include one or more LEDs connected in series with a first terminal or input terminal of strings 55-58 connected to a power input 52 in order to receive a load current 49. An embodiment of current 49 may be substantially the same as current 45 (FIG. 1). In one embodiment, input 52 may be connected to output 43 of FIG. 1. Those skilled in the art will appreciate that although strings 55-58 are illustrated to include three series connected LEDs, strings 58-58 may individually have one or more or any number of series connected LEDs.

Control circuit 67 may have an embodiment that may include a transistor 70 connected in series with string 55 such that a current 60 that flows through string 55 also flows through transistor 70 and a series connected current sense element 68. Those skilled in the art will appreciate that although current sense element 68 is illustrated as a resistor, element 68 may be any type of circuit that can sense the current flow through transistor 70. For example, transistor 70 may be formed as a SenseFET that has a current sensing output where the current sensing output may be the sense element. SENSEFET is a trademark of Semiconductor Components Industries, LLC (SCILLC) of Phoenix, Ariz. One example of a SENSEFET type of transistor is disclosed in U.S. Pat. No. 4,553,084 issued to Robert Wrathall on Nov. 12, 1985, which is hereby incorporated herein by reference. Circuit 67 may also include a sense input 76 is configured to receive a current sense signal that is representative of a current 61 that flows through string 56. An embodiment of circuit 67 may be configured to control transistor 70 to form the value of current 60 to be substantially equal to the value of current 61. In an embodiment, circuit 67 may include an amplifier 73 that may have a non-inverting input configured to receive a current sense signal that is representative of the value of current 61, such as for example signal 82 through a resistor 75. An embodiment of amplifier 73 may also have an inverting input configured to receive a current sense signal that is representative of current 60, such as for example signal 69 through a resistor 79, and form output signal 74 to be representative of a difference between the value of currents 60 and 61. Resistor 79 may, in an embodiment, be a portion of the current sensing element of circuit 67. Those skilled in the art will appreciate that resistor 79 may be replaced by other current sensing circuits. Amplifier 73 may have an embodiment that may include a feedback resistor 78 coupled between the inverting input and the output of amplifier 73. An optional capacitor 77 may be connected between the inverting input of amplifier 73 and return 53 in some embodiments. Capacitor may, in some embodiments, function as a filter and may also provide frequency stability. In some embodiments, optional resistors 71 and 72 may be connected between a power input terminal 51 and the respective non-inverting and inverting inputs of amplifier 73 in order to set a common mode voltage for amplifier 73. Input 51 may be connected to receive a voltage that may be near to the value of an operating voltage for circuit 50. The operating voltage may be from a source on the secondary side, such as for example on the secondary side of transformer 19 of FIG. 1 or may be from another auxiliary winding of transformer 19, and is from a different source than the current supplied to input 52.

Control circuit 80 may be configured similarly to circuit 67 and may operate similarly to circuit 67. Control circuit 80 may have an embodiment that may include a transistor 83 connected in series with string 56 such that current 61 that flows through string 56 also flows through transistor 83 and a series connected current sense element 81. Those skilled in the art will appreciate that although current sense element 81 is illustrated as a resistor element 81 may be any type of circuit that can sense the current flow through transistor 83. For example, transistor 83 may be formed as a SenseFET as explained hereinbefore. Circuit 80 may have an embodiment that includes a sense input 89 that may be configured to receive a current sense signal that is representative of a current 62 that flows through string 57. An embodiment of control circuit 80 may be configured to control transistor 83 to form the value of current 61 to be substantially equal to the value of current 62. In an embodiment, circuit 80 may also include an amplifier 86 that may have a non-inverting input configured to receive a current sense signal that is representative of the value of current 62, such as for example signal 97 through a resistor 88. Amplifier 86 may also have an inverting input configured to receive a current sense signal that is representative of current 61, such as signal 82 through a resistor 91, and form an output signal 87 to be representative of a difference between the value of currents 61 and 62. Resistor 91 may, in an embodiment, be a portion of the current sensing element of circuit 80. Those skilled in the art will appreciate that resistor 91 may be replaced by other current sensing circuits. Amplifier 86 may have an embodiment that may include a feedback resistor 92 coupled between the inverting input and the output of amplifier 86. An optional capacitor 90 may be connected between the inverting input of amplifier 86 and return 53 in some embodiments. In some embodiments, optional resistors 84 and 85 may be connected between power input terminal 51 and the respective non-inverting and inverting inputs of amplifier 86 in order to set a common mode voltage for amplifier 86.

Control circuit 95 may also be configured similarly to and operate similarly to circuit 67. Control circuit 95 may include a transistor 98 connected in series with string 57 such that a current 62 that flows through string 57 also flows through transistor 98 and a series connected current sense element 96. Those skilled in the art will appreciate that although current sense element 96 is illustrated as a resistor element 96 may be any type of circuit that can sense the current flow through transistor 98. For example, transistor 98 may be formed as a SenseFET as indicated hereinbefore. An embodiment of circuit 95 may include a sense input 104 that may be configured to receive a current sense signal that is representative of a current 63 that flows through string 58. In an embodiment, circuit 95 may be configured to control transistor 98 to form the value of current 62 to be substantially equal to the value of current 63 formed by control circuit 110. An embodiment of circuit 95 may include an amplifier 101 that has a non-inverting input configured to receive a current sense signal that is representative of the value of current 63, such as for example signal 112 through a resistor 103. Amplifier 101 may have an embodiment with an inverting input configured to receive a current sense signal that is representative of current 62, such as signal 97 through a resistor 106, and form a control signal 102 to be representative of a difference between the value of currents 62 and 63. Resistor 106 may, in an embodiment, be a portion of the current sensing element of circuit 95. Those skilled in the art will appreciate that resistor 106 may be replaced by other current sensing circuits. Amplifier 101 may have an embodiment that may include a feedback resistor 107 coupled between the inverting input and the output of amplifier 101. An optional capacitor 105 may be connected between the inverting input of amplifier 101 and return 53 in some embodiments. In some embodiments, optional resistors 99 and 100 may be connected between power input terminal 51 and the respective non-inverting and inverting inputs of amplifier 101 in order to set a common mode voltage for amplifier 101.

Control circuit 110 may also be configured similarly to and to operate similarly to circuit 67. Control circuit 110 may include a transistor 113 connected in series with string 58 such that current 63 that flows through string 58 also flows through transistor 113 and a series connected current sense element 96. Those skilled in the art will appreciate that although current sense element 111 is illustrated as a resistor, element 111 may be any type of circuit that can sense the current flow through transistor 113. For example, transistor 113 may be formed as a SenseFET as explained hereinbefore. Circuit 110 may also include a sense input 119 that may be configured to receive a current sense signal that is representative of current 60 of circuit 67. Control circuit 110 may have an embodiment that may be configured to control transistor 113 to form the value of current 63 to be substantially equal to the value of current 60. An embodiment of circuit 110 may include an amplifier 116 that has a non-inverting input configured to receive a current sense signal that is representative of the value of current 60, such as for example signal 69 through a resistor 118. An embodiment of amplifier 116 may also have an inverting input configured to receive a current sense signal that is representative of current 63, such as signal 112 through a resistor 121, and form signal a control signal 117 to be representative of a difference between the value of currents 63 and 60. Resistor 121 may, in an embodiment, be a portion of the current sensing element of circuit 110. Those skilled in the art will appreciate that resistor 121 may be replaced by other current sensing circuits. Amplifier 116 may have an embodiment that may include a feedback resistor 122 coupled between the inverting input and the output of amplifier 116. An optional capacitor 120 may be connected between the inverting input of amplifier 116 and return 53 in some embodiments. In some embodiments, optional resistors 114 and 115 may be connected between power input terminal 51 and the respective non-inverting and inverting inputs of amplifier 116 in order to set a common mode voltage for amplifier 116.

An embodiment of circuits 67, 80, 95, and/or 110 may be configured to receive optional dimming control signals or dimming signals that can be utilized to operate strings 55-58 out of phase relative to each other. For example, the current to one of strings 55-58 may be enabled to be supplied and the current to the others of strings 55-58 may be disabled or controlled to be substantially zero, and the current that is supplied may be adjusted to be substantially equal to load current 49 supplied to input 52, without changing the value of current 49. One or more of signals 83-86 may sequentially be asserted (while the other signals are negated) so that the current through one of strings 55-58 is sequentially controlled to be substantially equal to current 49 and the current through the other of strings 55-58 may be forced to be substantially zero.

For example, in control circuit 67 the non-inverting input of amplifier 73 may be configured to receive a first dimming signal 83, and the inverting input of amplifier 73 may be configured to receive one or more of dimming signals 84-86. For example, each of signals 84-86 may be wire "ORed" together, such as through input diodes as illustrated in FIG. 2, and applied to the inverting input through an isolation resistor. Similarly, control circuit 80 may include that the inverting input of amplifier 86 may receive a second dimming signal 84, and the inverting input of amplifier 86 may be configured to receive one or more of dimming signals 83 and 85-86. For example, signal 83 and signals 85-86 may be wire "ORed" together, such as through another set of input diodes as illustrated in FIG. 2, and applied to the inverting input through another isolation resistor. In an embodiment of control circuit 104, the non-inverting input of amplifier 101 may receive a third dimming signal 85, and the inverting input of amplifier 101 may be configured to receive one or more of dimming signals 83-84 and 86. Similarly as in circuits 67 and 80, an embodiment of circuit 95 may include that signals 83-84 and 86 may be wire "ORed" together, such as through another set of input diodes, and applied to the inverting input through another isolation resistor. Circuit 110 may similarly have an embodiment wherein the non-inverting input of amplifier 116 may be configured to receive a fourth dimming signal 86, such as through an input diode as illustrated in FIG. 2, and the inverting input of amplifier 116 may be configured to receive one or more of dimming signals 83-84 and 85. Signals 83-84 and 85 may be wire "ORed" together, such as through input diodes, and applied to the inverting input through still another isolation resistor.

Control circuit 50 may have an alternate embodiment that is configured to control less than four (4) strings of LEDs. For example an alternate embodiment may be configured to control two (2) strings, such as for example strings 55 and 56. For such an alternate embodiment, input 89 of circuit 80 may be configured to receive sense signal 69 instead of sense signal 97. Additionally, in such am embodiment, dimming signals 85-86 and the associated input diodes may be omitted. Thus, circuit 67 may receive signals 83 and 84 and circuit 80 may receive signals 84 and 83.

In operation, there may be a case in which the total amount of current supplied to input 52 may decrease. Assuming that signals 83-86 are all asserted, control circuit 50 may be configured to adjust currents 60-63 to be substantially equal in response to the decrease in load current 49. In an embodiment, currents 60-63, may be adjusted to divide current 49 substantially equally among currents 60-63.

Circuit 67 may be configured to form sense signal 69 that is representative of current 60 and receive signal 82 that is representative of current 61 and control transistor 70 to adjust the value of current 60 to be substantially equal to current 61. For example, amplifier 73 may receive a sense signal, through resistor 75 for example, that is representative of signal 61 and receive a sense signal that is representative of sense signal 69, such as for example through resistor 79, and form signal 74 to be representative of the difference between currents 60 and 61. Those skilled in the art will appreciate that circuit 67 operates transistor as an analog control element and not as a switch to adjust the value of current 60 responsively to changes in the analog control values of signal 74.

Similarly, circuit 80 may be configured to form sense signal 82 that is representative of current 61 and receive signal 97 that is representative of current 62, such as for example through resistor 88, and control transistor 83 to adjust the value of current 61 to be substantially equal to current 62. For example, amplifier 86 may receive a sense signal, through resistor 88 for example, that is representative of signal 97 and receive a sense signal that is representative of sense signal 82, such as for example through resistor 91, and form signal 87 to be representative of the difference between currents 61 and 62. Those skilled in the art will appreciate that circuit 80 operates transistor as an analog control element and not as a switch to adjust the value of current 61 responsively to changes in the analog control values of signal 87.

Additionally, circuit 95 may be configured to form sense signal 97 that is representative of current 62 and receive signal 112 that is representative of current 63, such as for example through resistor 103, and control transistor 98 to adjust the value of current 62 to be substantially equal to current 63. For example, amplifier 101 may receive a sense signal, through resistor 103 for example, that is representative of signal 112 and receive a sense signal that is representative of sense signal 97, such as for example through resistor 106, and form signal 102 to be representative of the difference between currents 62 and 63. Those skilled in the art will appreciate that circuit 95 operates transistor 98 as an analog control element and not as a switch to adjust the value of current 62 responsively to changes in the analog control values of signal 102.

Further, circuit 110 may be configured to form sense signal 112 that is representative of current 63 and receive signal 69 that is representative of current 60, such as for example through resistor 118, and control transistor 113 to adjust the value of current 63 to be substantially equal to current 60. For example, amplifier 116 may receive a sense signal that is representative of signal 69, such as through resistor 118 for example, and receive a sense signal that is representative of sense signal 112, such as for example through resistor 121, and form signal 117 to be representative of the difference between currents 63 and 60. Those skilled in the art will appreciate that circuit 110 operates transistor 113 as an analog control element to adjust the value of current 63 responsively to changes in the analog control values of signal 117.

For an alternate embodiment of circuit 50 that is configured to control only two strings of LEDs, such as for example strings 55 and 56, circuit 80 may be configured to receive a sense signal that is representative of current 60, such as for example a signal that is representative of sense signal 69, instead of receiving signal 97. Circuit 80 may also be configured to receive a sense signal that is representative of current 61 and control current 61 to be substantially equal to current 60 instead of substantially equal to current 62.

In another embodiment, during operation one of dimming signals 83-86, that may be utilized to enable one of strings 55-58 and the other dimming signals may be utilized to disable the other of strings 55-58. For such a condition, circuit 50 is configured to adjust the values of the remaining currents to be substantially equal wherein the sum of the remaining currents is substantially equal to the value of load current 49.

Figure 3:
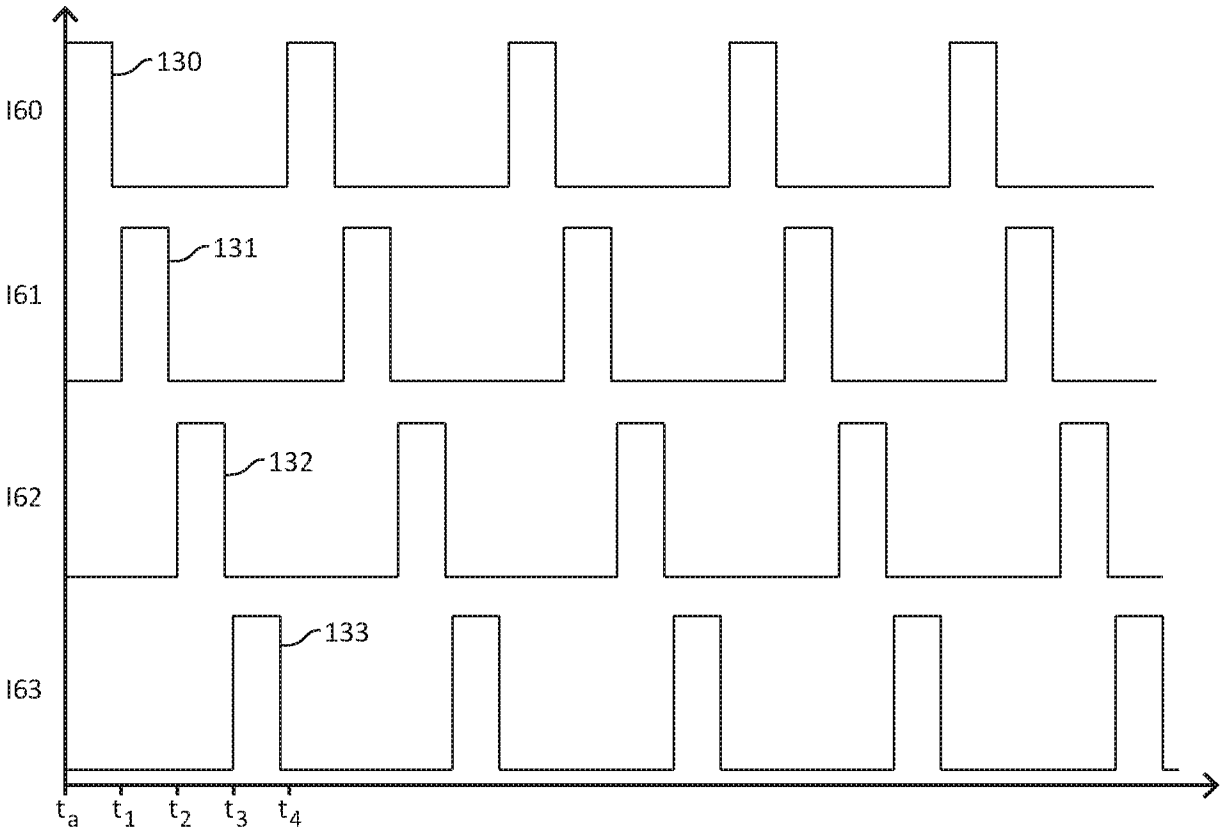
FIG. 3 is a graph having plots that illustrate example of some of the signals of the controller of FIG. 2 in accordance with the present invention.

FIG. 3 is a graph having plots that illustrate currents 60-63 during dimming operation of circuit 50. The abscissa indicates time and the ordinate indicates increasing value of the illustrated signals. A plot 130 illustrates current 60, a plot 131 illustrates current 61, a plot 132 illustrates current 62, and a plot 133 illustrates current 63. This description has references to FIG. 2 and FIG. 3. Assume, for example, that at a time t0 dimming signal 83 is asserted, such as for example a high voltage near to or substantially the same as the voltage of input 51, and signals 84-86 are negated, such as for example a low voltage near to or substantially the same as the voltage of return 53.

Circuit 80 receives the negated value of signal 84 which forces the non-inverting input of amplifier 73 low. The asserted value of signal 83, along with the negated value of signals 85-86, forces the inverting input of amplifier 86 high which forces control signal 87 low thereby disabling transistor 83 and forcing current 61 to be substantially zero as illustrated by plot 131. Similarly, circuit 95 receives the asserted value of signal 83 and the negated value of signals 84-86. The negated value of signal 85 forces the non-inverting input of amplifier 101 high. The asserted value of signal 83 and the negated value of signals 84 and 86 force the inverting of amplifier 101 input high which forces control signal 87 low thereby disabling transistor 98 and forcing current 62 to be substantially zero as illustrated by plot 132. Also, circuit 110 receives the asserted value of signal 83 and the negated value of signals 84-86. The negated value of signal 86 forces the non-inverting input of amplifier 116 high. The asserted value of signal 83, along with the negated value of signals 84-85, force the inverting input of amplifier 116 high which forces control signal 117 low thereby disabling transistor 113 and forcing current 63 to be substantially zero as illustrated by plot 133.

However, circuit 67 receives the asserted value of signal 83 which forces the non-inverting input of amplifier 73 high. The negated value of signals 84-86 forces the inverting input of amplifier 86 low which forces control signal 74 high thereby enabling transistor 70 and forcing current 60 to be substantially equal to current 49 as illustrated by plot 130. Thus, circuit 50 adjust the values of current 60 to be substantially equal to the load current and adjusts currents 61-63 to be substantially zero.

At a time t1, assume that signal 83 is negated along with signals 85-86 and that signal 84 is asserted. In circuits 67, 95 and 110, the asserted value of signal 84 and the negated value of signals 83 and 85-86 result in disabling respective transistors 70, 98, and 113 as illustrated by respective plots 130, 132, and 133 around time t1 and between times t1 and t2. For circuit 80, the asserted value of signal 84 and the negated value of signals 83 and 85-86 result in enabling transistor 83 thereby causing current 61 to be substantially equal to current 49.

As illustrated by plots 130-133 at times t3-t4 and beyond, one of signals 83-86 is sequentially asserted and the other signals negated to sequentially activate one of currents 60-63 and to disable the other of currents 60-63. In applications such as for example backlighting of LED/LCD televisions, this operation can be utilized for operating the televisions in the three-dimensional (3D) viewing mode.

For the alternate embodiment where controller 50 may be configured to operate two (2) strings, such as for example strings 55-56, dimming signals 85-86 may be omitted. In such an alternate embodiment if dimming signal 83 is asserted and dimming signal 84 is negated, circuit 67 enables transistor 70 and controls current 60 to be substantially current 49 and circuit 80 disables transistor 83 to control current 61 to be substantially zero. For example, circuit 67 receives the asserted value of signal 83 and the negated value of signal 84 which forces signal 74 high to enable transistor 70. Circuit 80 receives the asserted value of signal 83 and the negated value of signal 84 which forces signal 87 low to disable transistor 83 which forms current 61 to be substantially zero.

From the foregoing, those skilled in the art will appreciate that circuit 50 is configured to receive LED currents from a plurality of stings of series connected LEDs and to selectively enable one of the LED currents to be substantially equal to a load current received by the plurality of strings, and to selectively disable the LED current from all the other strings.

In order to assist with the foregoing operation, an embodiment of circuit 50 may include an input 52 that is configured to receive a load current from a secondary side of a power supply. Circuit 67 may include an input configured to be connected to an LED of a string of series connected LEDs, such as for example string 55, to receive a current from the string. Transistor 70 may have a drain connected to the input to receive the current, a gate connected to the output of amplifier 73 to receive signal 74, and a source coupled to a first terminal of sense element 68. A second terminal of element 68 may be connected to return 53. Sense input 76 may be connected to a first terminal of a resistor 75 which has a second terminal commonly connected to the non-inverting input of amplifier 73, a first terminal of optional resistor 71, and to an anode of an input diode which has a cathode connected to receive signal 83. A second terminal of resistor 71 may be connected to supply input 51 and to a first terminal of resistor 72. A second terminal of resistor 72 may be commonly connected to the inverting input of amplifier 73, a first terminal of resistor 78, a first terminal of resistor 79, a first terminal of capacitor 77, and a first terminal of an isolation resistor. A second terminal of the isolation resistor may be commonly connected to an anode of a second input diode which has a cathode connected to receive signal 84, an anode of a third input diode which has a cathode connected to receive signal 85, and an anode of a fourth input diode which has an cathode connected to receive signal 86. A second terminal of resistor 78 may be connected to the output of amplifier 83. A second terminal of resistor 79 may be connected to the first terminal of element 68, and a second terminal of capacitor 77 may be connected to return 53. An embodiment of circuit 80 may include an input that is configured to be connected to an LED of a string of series connected LEDs, such as for example string 56, to receive a current from the LEDs. Transistor 83 may have a drain connected to the input to receive the current, a gate connected to the output of amplifier 86 to receive signal 87, and a source coupled to a first terminal of sense element 81. A second terminal of element 81 may be connected to return 53. Sense input 89 may be connected to a first terminal of a resistor 88 which has a second terminal commonly connected to the non-inverting input of amplifier 86, a first terminal of optional resistor 84, and two and anode that an input diode which has a cathode connected to receive signal 84. A second terminal of resistor 84 may be commonly connected to input 51 and to a first terminal of resistor 85. A second terminal of resistor 85 may be commonly connected to the inverting input of amplifier 86, a first terminal of resistor 92, a first terminal of resistor 91, a first terminal of capacitor 70, and a first terminal of an isolation resistor.

A second terminal of the isolation resistor may be commonly connected to an anode of a second input diode which has a cathode connected to receive signal 83, and anode of another input diode which has a cathode connected to receive signal 85, and an anode of a fourth input diode which has a cathode connected to receive signal 86. A second terminal of resistor 92 may be connected to the output of amplifier 86 and to a gate of transistor 83. A second terminal of resistor 91 may be commonly connected to a first terminal of element 81 and to a source of transistor 83. A second terminal of capacitor 90 may be commonly connected to return 53 and to a second terminal of element 81. Circuit 95 may have an embodiment that may include an input configured to be connected to a string of series connected LEDs, such as for example string 57, to receive a current from the string. Transistor 98 may have a drain connected to the input to receive the current, a gate connected to the output of amplifier 101 to receive signal 102, and a source coupled to a first terminal of sense element 96. A second terminal of element 96 may be connected to return 53. Sense input 104 may be connected to a first terminal of a resistor 103 which has a second terminal commonly connected to the non-inverting input of amplifier 101, a first terminal of optional resistor 99, and to an anode that an input diode which has a cathode connected to receive signal 85. A second terminal of resistor 99 may be connected to supply input 51 and to a first terminal of resistor 100. A second terminal of resistor 100 may be commonly connected to the inverting input of amplifier 101, a first terminal of resistor 107, a first terminal of resistor 106, a first terminal of capacitor 105, and a first terminal of an isolation resistor. A second terminal of the isolation resistor may be commonly connected to an anode of a second input diode which has a cathode connected to receive signal 83, and anode of a third input diode which has a cathode connected to receive signal 84, and an anode of a fourth input diode which has a cathode connected to receive signal 86. A second terminal of resistor 107 may be connected to the output of amplifier 101. A second terminal of resistor 106 may be connected to the first terminal of element 96, and a second terminal of capacitor 105 may be connected to return 53. Circuit 110 may include an input configured to be connected to an LED of a string of series connected LEDs, such as for example string 58, to receive a current from the string. Transistor 113 may have a drain connected to the input to receive a current, a gate connected to the output of amplifier 116 to receive signal 117, and a source coupled to a first terminal of sense element 111. A second terminal of element 111 may be connected to return 53. Sense input 119 may be connected to a first terminal of a resistor 118 which has a second terminal commonly connected to the non-inverting input of amplifier 116, a first terminal of optional resistor 114, and to an anode of an input diode which has a cathode connected to receive signal 86. A second terminal of resistor 114 may be connected to input 51 and to a first terminal of input 115. A second terminal of resistor 115 may be commonly connected to the inverting input of amplifier 116, a first terminal of resistor 122, a first terminal of resistor 121, a first terminal of capacitor 120, and a first terminal of an isolation resistor. A second terminal of the isolation resistor may be commonly connected to an anode of a second input diode which is a cathode connected to receive signal 83, and anode of a third input diode which has a cathode connected to receive signal 84, and an anode of a fourth input diode which has a cathode connected to receive signal 85. A second terminal of resistor 122 may be connected to the output of amplifier 116. A second terminal of resistor 122 may be connected to the first terminal of element 111, and a second terminal of capacitor 120 may be connected to return 53.

In an embodiment, it may be advantageous to control transistors 70, 83, 98, 113 to operate in the linear mode which may assist in absorbing the difference of voltage that may exist between strings 55-58. For example, some LEDs may have different voltage drops which may cause one or more of strings 55-58 to have a different voltage drop. Controlling transistors 70, 83, 98, 113 to operate in the linear mode may allow one or more of transistors 70, 83, 98, 113 to have a different voltage drop which may facilitate controlling the voltage drop of each of strings 55-58 and the transistor of transistors 70, 83, 98, 113 to have a substantially equal total voltage drop.

Figure 4:
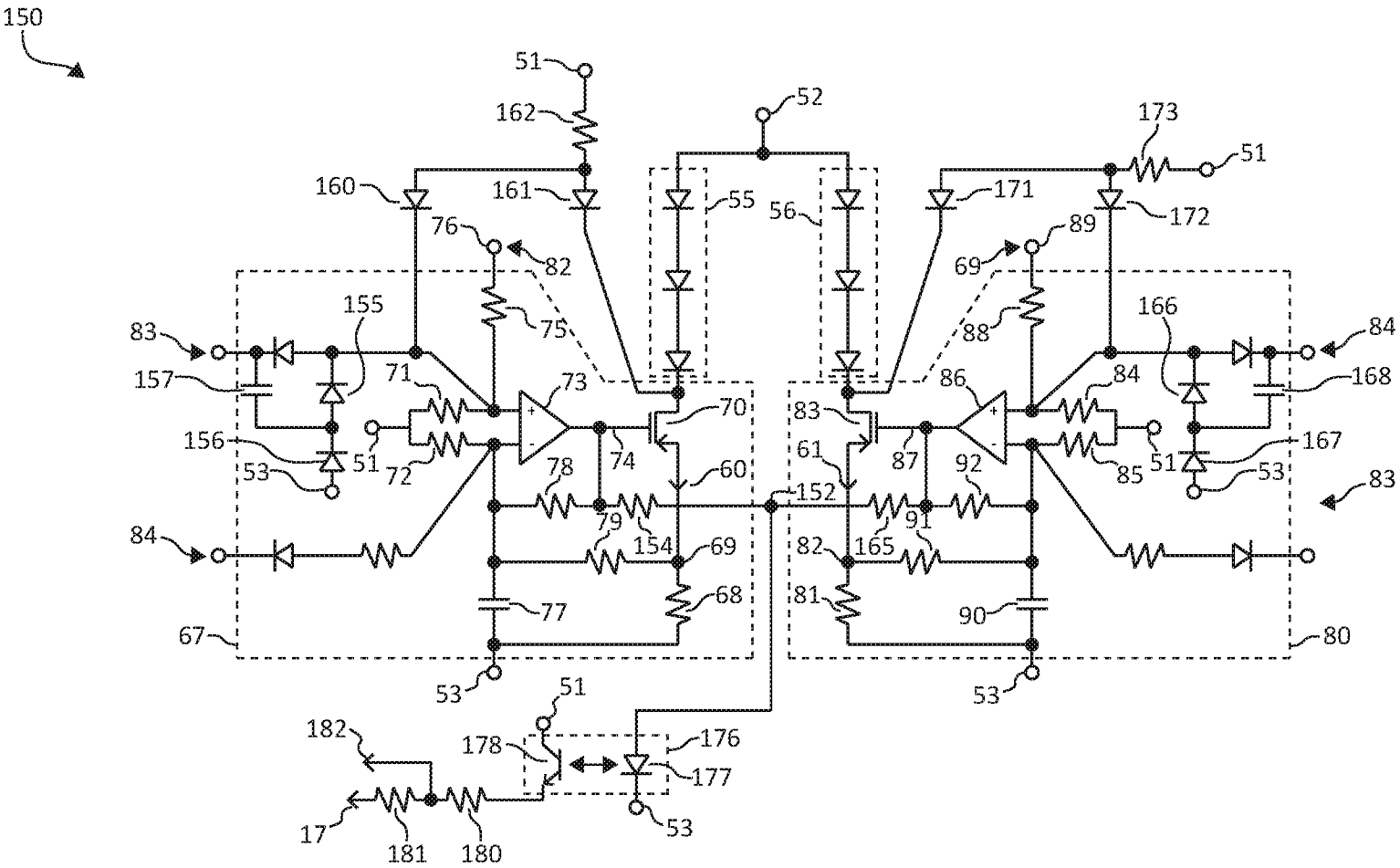
FIG. 4 schematically illustrates an example of an embodiment of an LED control circuit that may be an alternate embodiment of the control circuit of FIG. 2 in accordance with the present invention.

FIG. 4 schematically illustrates an example of an embodiment of an LED control circuit 150 that may be an alternate embodiment of control circuit 48 illustrated in FIG. 1 and may be an alternate embodiment of a portion of circuit 50 in FIG. 2. In some embodiments, there may occur a case in which the unbalance in the voltage drop across one or more of strings 55-58 is great enough to greatly increase the amount of power that has to be dissipated by the corresponding one or more of transistors 70, 83, 98, 113 (FIG. 2). By controlling the voltage on the drain of transistors 70, 83, 98, 113 (FIG. 2) when the transistors are active and considering the current adjusted, circuit 150 is configured to control the voltage and control the current balancing to reduce the power dissipation and to minimize damaging circuit 150. In an embodiment, currents 60 and 62 may not be completely balanced but the power dissipation may be reduced.

Some embodiments of circuit 200 may include a circuit that assists in disabling the primary side from generating power to the secondary side in the event that one or more of strings 55-56 is not conducting current. An embodiment may monitor the drive signal to each of transistors 70 and 83 and form a signal at a node 152 that is representative of a driven or not driven state of the drive signals. Circuit 200 may have an embodiment that sums the drive signals to transistors 70 and 83 and forms a signal at a node 152 that is representative of the drive signals. If one of the drive signals decreases below a threshold value, the signal on node 152 may decrease. In an embodiment, the drive signal may decrease to less than the threshold value of the associated transistor and signal 152 may decrease towards the value of return 53. In one example embodiment, signal 152 may decrease to substantially the value of return 53. Coupler 176 receives the value of the signal on node 152 and forms a secondary side status signal on an output 182. Some embodiments may use the signal on output 182 to disable switching of the primary side and to inhibit the primary side from providing power to the secondary side under the condition that signal on output 182 may be greater than a power threshold value. In an embodiment, the status signal on output 182 may be connected to input 36 in FIG. 1. Stopping the primary side switching prevents the secondary side voltage from increasing to a value that may damage strings 55-56 of circuit 150.

Some embodiments of circuit 200 may include a circuit that detects a fault condition of either or both of strings 55-56. An embodiment may include that if the drain voltage of transistor 70 increases to a value greater than the voltage on input 51, diode 161 conducts current which enables transistor 205 to conduct current from input 83 causing the emitter voltage of transistor 205 to increase, allowing conduction and forming a fault signal 207 on the collector of transistor 205. Similarly, if the drain voltage of transistor 83 increases to a value greater than the voltage on input 51, diode 171 conducts current which enables transistor 210 to conduct current from input 84 causing the emitter voltage of transistor 210 to increase, allowing conduction and forming a fault signal 212 on the collector of transistor 210. In some embodiments, signals 207 and 212 may be connected together together to form a single fault signal. Either of signals 207 or 212 may be applied to a secondary side control logic, such as a microprocessor or other control logic, to inform the control logic that a fault condition may have occurred. The fault signal may be used to stop the secondary side through the control logic. In an embodiment, the control logic may include a comparator that may compare the fault signal to a fault threshold reference value and a latch may latch the fault condition in response to the fault signal having a value greater than the fault threshold. If only one of strings 55-56 or alternately transistors 70 and 83 are disabled, the total current received on input 52 will be conducted through the non-disabled string and/or transistor.

Circuit 150 is similar to circuit 50 but only illustrates alternate embodiments of circuits 67 and 80 from FIG. 2 with additional elements to control transistors 70 and 83. Those skilled in the art will appreciate that circuit 150 is configured to adjust currents 60 and 61 to be substantially equal without changing the value of the source supplied to input 52.

The alternate embodiment of circuit 67 may include a diode 155 coupled to the non-inverting input of amplifier 73. Diode 155 has a cathode commonly connected to the non-inverting input of amplifier 73 and to a cathode of a diode 160. An anode of diode 155 is commonly connected to a first terminal of a capacitor 157 and a cathode of a diode 156. A second terminal of capacitor 157 is connected to receive signal 83. An anode of diode 156 is connected to return 53. An anode of diode 160 is commonly connected to an anode of diode 161 and a first terminal of a resistor 162. The cathode of diode 161 is connected to the drain of transistor 70. A second terminal of resistor 162 is connected to source 51. The alternate embodiment of circuit 67 may also include a resistor 154 that has a first terminal connected to the output of amplifier 73 and a second terminal connected to a common node 152.

Similarly, the alternate embodiment of circuit 80 may include a diode 166 coupled to the non-inverting input of amplifier 86. Diode 166 has a cathode commonly connected to the non-inverting input of amplifier 86 and to a cathode of a diode 172. An anode of diode 166 is commonly connected to a first terminal of a capacitor 168 and to a cathode of a diode 167. A second terminal of capacitor 168 is connected to receive signal 84. An anode of diode 167 is connected to return 53. An anode of diode 172 is commonly connected to an anode of a diode 171 and to a first terminal of a resistor 173. A second terminal of resistor 173 is connected to source 51. A cathode of diode 171 is connected to the drain of transistor 83. The alternate embodiment of circuit 80 may also include a resistor 165 that has a first terminal connected to the output of amplifier 86 and a second terminal connected to node 52.

Circuit 150 may have an embodiment that includes an optical coupler 176 that may be coupled to receive a signal from node 152. Coupler 176 may include an optical emitter 177 and an optical detector 178. In an embodiment, detector 178 may be an optical transistor having a collector connected to source 51 and an emitter connected to a first terminal of a resistor 180. A second terminal of resistor 180 may be configured to form the secondary side status signal on status output 182. The second terminal of resistor 180 is also connected to a first terminal of a resistor 181 which may have a second terminal connected to the common return 17 (FIG. 1) of the primary side.

Those skilled in the art will appreciate that this scheme of circuit 150 can be expanded or added to circuit 50 of FIG. 2. For example, circuits 95 and 110 may have alternate embodiments that may include elements such as diodes 155-156 and 160-161 along with capacitor 157 and resistor 162 of circuit 67.

Figure 5:
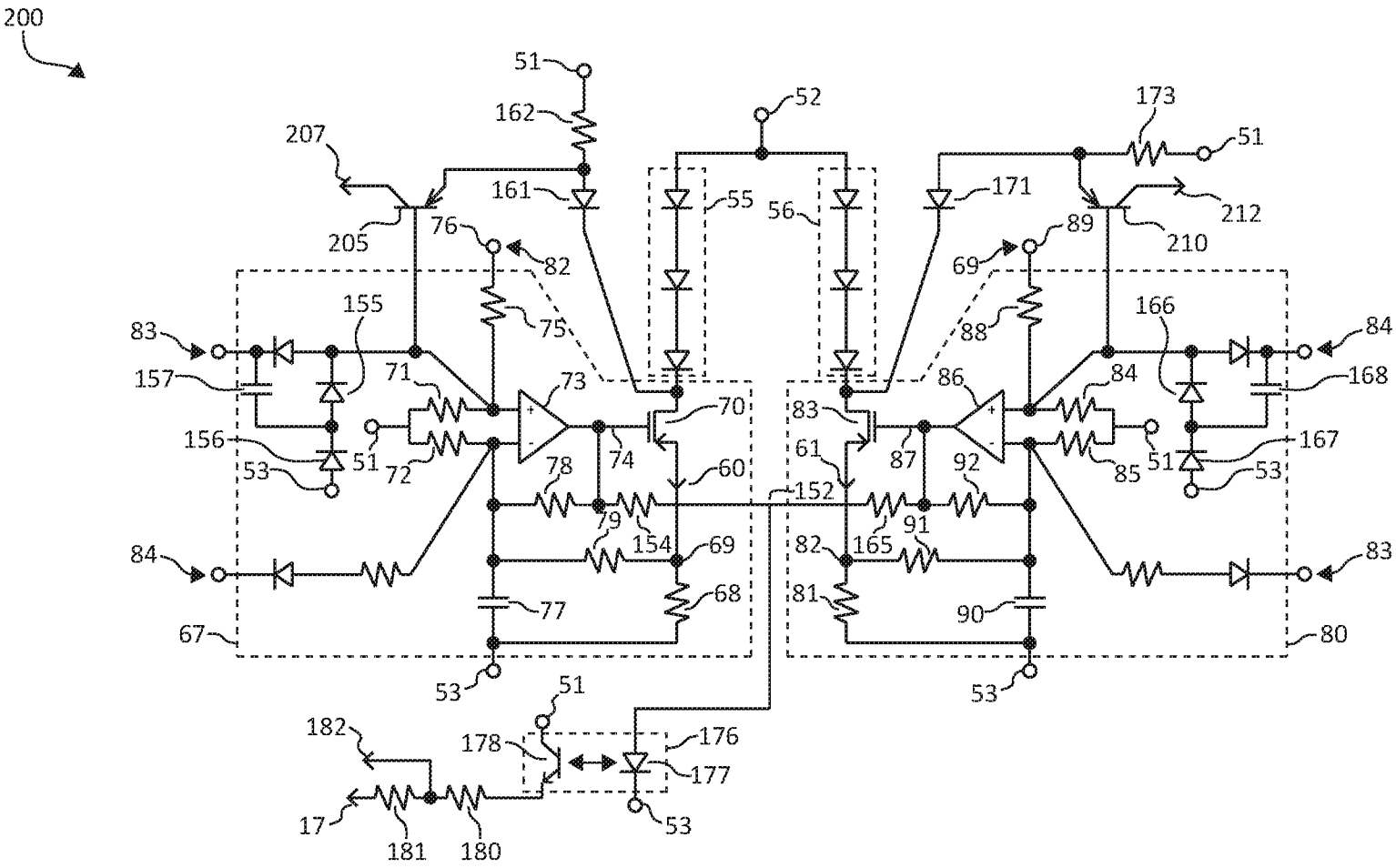
FIG. 5 schematically illustrates an example of an embodiment of an LED control circuit that may be an alternate embodiment of the control circuit of FIG. 4 or FIG. 2 in accordance with the present invention.

FIG. 5 schematically illustrates an example of an embodiment of an LED control circuit 200 that may be an alternate embodiment of circuit 150 (FIG. 4) and/or circuit 50 (FIG. 2). Circuit 200 is similar to circuit 150 but circuit 200 may be configured to form a separate fault signal for each of strings 55-56. For example circuit 67 may have an alternate embodiment that may be configured to form a fault signal 207 indication that string 55 may have an over power condition. Additionally, circuit 80 may have an alternate embodiment that may be configured to form a fault signal 212 indication that string 56 may have an over power condition. Fault signals 207 and/or 212 may be used by a micro-controller, such as for example a micro-processor or comparator of other type of control circuit, to inhibit forming the dimming signals, such as signals 83 and/or 84. For example, signal 207 may be used to force signal 83 low to inhibit operating string 55.

Figure 6:
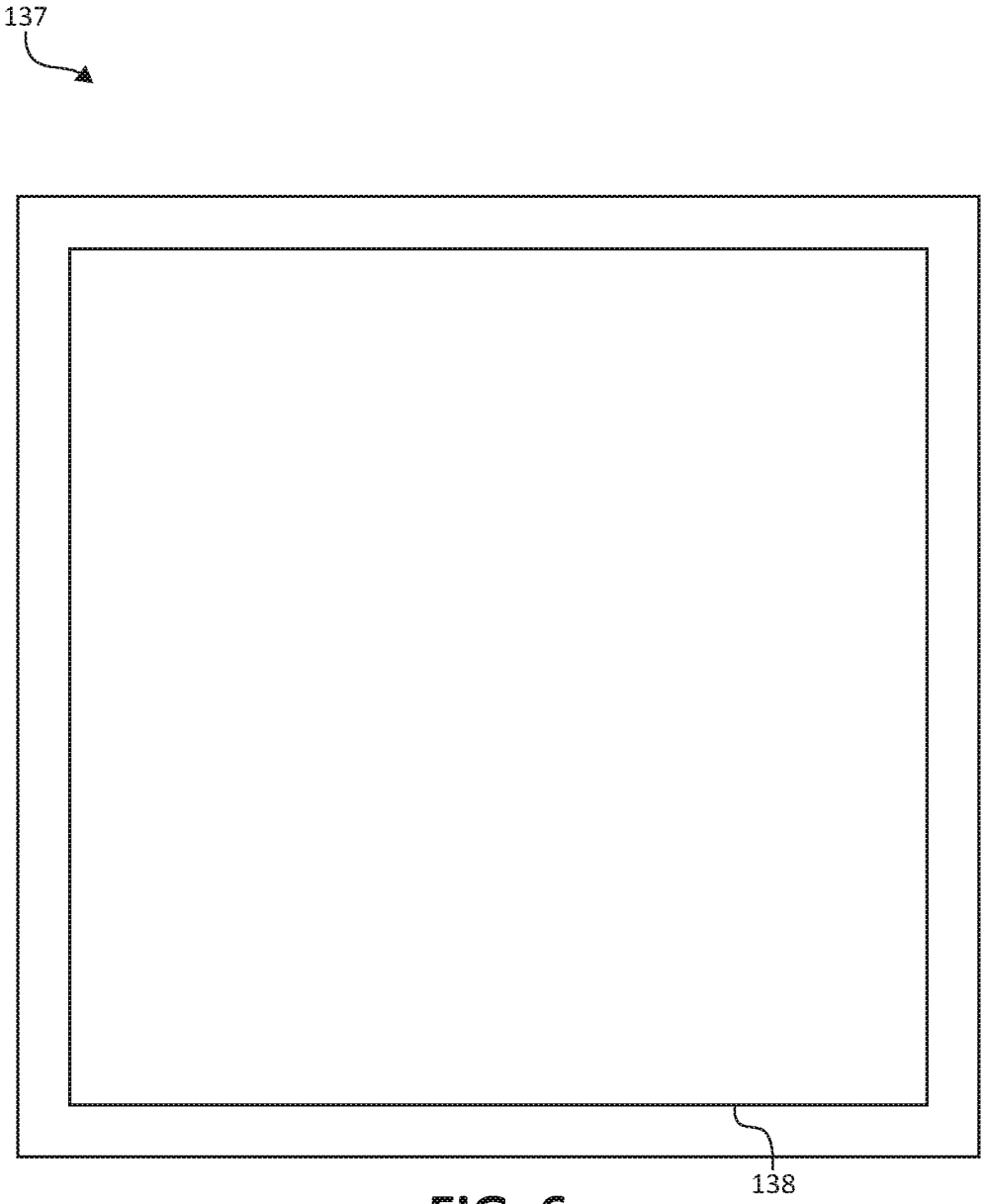
FIG. 6 illustrates an enlarged plan view of a semiconductor device that includes the power system of FIG. 1 in accordance with the present invention.

FIG. 6 illustrates an enlarged plan view of a portion of an embodiment of a semiconductor device or integrated circuit 137 that is formed on a semiconductor die 138. An embodiment of circuit 50 may be formed on die 138. Die 138 may also include other circuits that are not shown in FIG. 6 for simplicity of the drawing. Circuit 50 and device or integrated circuit 137 are formed on die 138 by semiconductor manufacturing techniques that are well known to those skilled in the art. Those skilled in the art will appreciate that circuits 150 or 200, or portions thereof, may also be formed on die 138 instead of or along with circuit 50.

From all the foregoing, those skilled in the art will appreciate that an example of an embodiment of an LED current balancing circuit may comprise, a first amplifier, such as for example an amplifier 73, having an inverting input configured to receive a first signal, such as for example the signal from resistor 79 or alternately signal 69, that is representative of a first current, such as for example current 60, through a first string, such as for example string 55, of series connected LEDs, and having a non-inverting input configured to receive a second signal, such as for example the signal from resistor 75 or alternately signal 82, that is representative of a second current, such as for example current 61, through a second string, such as for example string 56, of series connected LEDs, the first amplifier having an output configured to form a first control signal, such as for example signal 74, that is representative of a difference between the first current and the second current;

a first control transistor, such as for example transistor 70, configured to receive the first control signal and adjust the first current to be substantially equal to the second current;

a second amplifier, such as for example amplifier 86, having an inverting input configured to receive a third signal, such as for example the signal from resistor 91 or alternately signal 82, that is representative of the second current, and having a non-inverting input configured to receive the first signal or a signal that is representative of the first signal, the second amplifier having an output configured to form a second control signal, such as for example signal 87, that is representative of a difference between the second current and the first current; and a second control transistor, such as for example transistor 83, configured to receive the second control signal and adjust the second current to be substantially equal to the first current.

In an embodiment, the first amplifier may be configured to disable the first control transistor responsively to a first value of a first dimming control signal and the second amplifier is configured to disable the second control transistor responsively to a first value of the second dimming control signal.

Another embodiment may include that the non-inverting input of the first amplifier and the inverting input of the second amplifier may be configured to receive a first dimming control signal, the inverting input of the first amplifier and the non-inverting input of the second amplifier are configured to receive a second dimming control signal wherein the first amplifier is configured to disable the first control transistor responsively to a first value of the first dimming control signal and a second value of the second dimming control signal wherein the first value and the second value or different, and wherein the second amplifier is configured to increase the second current.

The second amplifier may have an embodiment that may be configured to adjust the second current to be substantially equal to a total current received by the first and second strings of series connected LEDs.

In an embodiment, the second amplifier may be configured to disable the second control transistor responsively to a second value of the first dimming control signal and a first value of the second dimming control signal and wherein the first amplifier is configured to increase the first current.

The second amplifier may have an embodiment that may be configured to adjust the first current to be substantially equal to a total current received by the first and second strings of series connected LEDs.

An embodiment may include that the output of the first amplifier may be coupled to a control electrode of the first control transistor, the first control transistor having a first current carrying electrode coupled to receive the first current and a second current carrying electrode coupled to a sense element that is configured to form the first signal that is representative of the first current.

An embodiment may include that the output of the second amplifier may be coupled to a control electrode of the second control transistor, the second control transistor having a first current carrying electrode coupled to receive the second current and a second current carrying electrode coupled to another sense element that is configured to form the second signal that is representative of the second current.

In an embodiment, the first and second strings may be configured to receive a total current and the LED current balancing circuit is configured to adjust the first current to be substantially equal to the second current in response to a change in the total current (total input current from PWM changes).

An embodiment may include that the first and second strings may be configured to receive a total current and the LED current balancing circuit is configured to adjust the first current to be substantially equal to the second current without changing the total current (LED may change that changes one of the LED string currents so total current doesn't change).

Those skilled in the art will also appreciate that an example of an embodiment of an LED current balancing circuit may comprise, a first amplifier, such as for example amplifier 73, having an inverting input configured to receive a first signal, such as for example a signal from resistor 79 or alternately signal 69, that may be representative of a first current, such as for example current 60, through a first string, such as for example string 55, of series connected LEDs, and having a non-inverting input configured to receive a second signal, such as for example the signal from resistor 75 or alternately signal 82, that may be representative of a second current, such as for example current 61, through a second string, such as for example string 56, of series connected LEDs, the first amplifier having an output configured to form a first control signal that is representative of a difference between the first current and the second current;

a first control transistor, such as for example transistor 70, configured to receive the first control signal and adjust the first current to be substantially equal to the second current;

a second amplifier, such as for example amplifier 86, having an inverting input configured to receive a third signal, such as the signal from resistor 91 or alternately signal 82, that is representative of the second current, and having a non-inverting input configured to receive a fourth signal, such as for example the signal from resistor 88 or alternately signal 89, that is representative of a third current, such as for example current 62, through a third string, such as for example string 57, of series connected LEDs, the second amplifier having an output configured to form a second control signal, such as for example signal 87, that is representative of a difference between the second current and the third current;

a second control transistor, such as for example transistor 83, configured to receive the second control signal and adjust the second current to be substantially equal to the third current;

a third amplifier, such as for example amplifier 101, having an inverting input configured to receive a fifth signal, such as for example signal from resistor 106 or alternately signal 97, that is representative of the third current, and having a non-inverting input configured to receive a sixth signal, such as for example the signal from resistor 103 or alternately signal 112, that is representative of a fourth current, such as for example current 63, through a fourth string, such as for example string 58, of series connected LEDs, the third amplifier having an output configured to form a third control signal that is representative of a difference between the third current and the fourth current; and a third control transistor, such as for example transistor 98, configured to receive the third control signal and adjust the third current to be substantially equal to the fourth current.

Another embodiment may also include a fourth amplifier, such as for example amplifier 116, having an inverting input configured to receive a seventh signal that is representative of the fourth current, and having a non-inverting input configured to receive an eighth signal that is representative of the first current, the fourth amplifier having an output configured to form a fourth control signal that is representative of a difference between the fourth current and the first current; and a fourth control transistor, such as for example transistor 113, configured to receive the fourth control signal and adjust the fourth current to be substantially equal to the first current.

An embodiment may include that the first amplifier may be configured to disable the first control transistor responsively to a first value of a first dimming control signal and a second value of a second dimming control signal wherein the second amplifier is configured to increase the second current; and the second amplifier may be configured to disable the second control transistor responsively to a first value of the second dimming control signal and a second value of the first dimming control signal wherein the second amplifier is configured to increase the first current.

Those skilled in the art will also appreciate that an example of an embodiment of an LED current balancing circuit may comprise, first control circuit, such as for example circuit 67 configured to form a first current sense signal that is representative of a first current, such as for example current 60, through a first string of series connected LEDs, such as for example string 55;

the first control circuit having a first input, such as for example input 76, coupled to receive a second current sense signal, such as for example signal 82, that is representative of a second LED current, such as for example current 61, through a second string of series connected LEDs, such as for example string 56;

the first control circuit configured to form a first control signal, such as for example signal 74 that is representative of a difference between the first current and the second current; and the first control circuit configured to drive a first transistor, such as for example transistor 70, responsively to the first control signal to adjust a value of the first current to be substantially equal to a value of the second current.

Another embodiment may further include a second control circuit, such as for example circuit 80, configured to form the second current sense signal;

the second control circuit having a first input coupled to receive a third current sense signal that is representative of one of the first current or a third LED current through a third string of series connected LEDs;

the second control circuit configured to form a second control signal that is representative of a difference between the second current and one of the first current or the third current; and the second control circuit configured to adjust a value of the second current responsively to the second control signal to be substantially equal to one of the first current or the third current.

An embodiment may include that the first control circuit may have a first amplifier having a non-inverting input configured to receive a first signal that is representative of the second current sense signal and an inverting input configured to receive a second signal that is representative of the first current sense signal, the amplifier having an output configured to form the first control signal.

In an embodiment, the non-inverting input of the first amplifier may be configured to receive a first dimming control signal and the inverting input of the first amplifier is configured to receive a second dimming control signal wherein first amplifier is configured to disable a first control transistor responsively to a first value of the first dimming control signal and a second value of a second dimming control signal wherein the second amplifier is configured to increase the second current.

In view of all of the above, it is evident that a novel device and method is disclosed. Included, among other features, is forming a controller that can adjust the currents through two or more strings of LEDs to be substantially equal if the value of the load current supplied to the strings of LEDs changes or adjust the currents to be substantially equal without changing the value of the load current. Those skilled in the art will appreciate that circuit 50 uses an amplifier with multiple input terminals to provide accurate control of the current through each LED string, such as currents 60-63. Circuit 50 does not have a bipolar transistor in the current flow path of any of currents 60-63 because, for example, such bipolar transistors have greater temperature and variations and part to part variations that result in less accurate control of the Led currents. Circuit 50 also directly compares the current in one LED string with that of another LED string which also increases the accuracy. Circuit 50 also does not have an over current shutoff feature and thereby avoids a conflict between the current adjust and the over current limitation. Additionally, circuit 50 also does not have an undercurrent shutoff feature and thereby avoids a conflict between the current adjust and the under current limitation. Circuit 50 further is configured to stop current flow in all but one string which facilitates implements the 3-D feature of some display devices.

While the subject matter of the descriptions are described with specific preferred embodiments and example embodiments, the foregoing drawings and descriptions thereof depict only typical and examples of embodiments of the subject matter and are not therefore to be considered to be limiting of its scope, it is evident that many alternatives and variations will be apparent to those skilled in the art. As will be appreciated by those skilled in the art, the example form of controller 50 is used as a vehicle to explain the operation method of adjusting the currents in multiple strings of LEDs.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. An LED current balancing circuit comprising:

a first amplifier having an inverting input configured to receive a first signal that is representative of a first current through a first string of series connected LEDs, and having a non-inverting input configured to receive a second signal that is representative of a second current through a second string of series connected LEDs, the first amplifier having an output configured to form a first control signal that is representative of a difference between the first current and the second current;

a first control transistor configured to receive the first control signal and adjust the first current to be substantially equal to the second current;

a second amplifier having an inverting input configured to receive a third signal that is representative of the second current, and having a non-inverting input configured to receive the first signal or a signal that is representative of the first signal, the second amplifier having an output configured to form a second control signal that is representative of a difference between the second current and the first current;

a second control transistor configured to receive the second control signal and adjust the second current to be substantially equal to the first current; and wherein the first amplifier is configured to disable the first control transistor responsively to a first value of a first dimming control signal and the second amplifier is configured to disable the second control transistor responsively to a first value of the second dimming control signal.

2. The LED current balancing circuit of claim 1 wherein the output of the first amplifier is coupled to a control electrode of the first control transistor, the first control transistor having a first current carrying electrode coupled to receive the first current and a second current carrying electrode coupled to a sense element that is configured to form the first signal that is representative of the first current.

3. The LED current balancing circuit of claim 1 wherein the output of the second amplifier is coupled to a control electrode of the second control transistor, the second control transistor having a first current carrying electrode coupled to receive the second current and a second current carrying electrode coupled to another sense element that is configured to form the second signal that is representative of the second current.

4. The LED current balancing circuit of claim 1 wherein the first and second strings are configured to receive a total current and the LED current balancing circuit is configured to adjust the first current to be substantially equal to the second current in response to a change in the total current.

5. The LED current balancing circuit of claim 1 wherein the first and second strings are configured to receive a total current and the LED current balancing circuit is configured to adjust the first current to be substantially equal to the second current without changing the total current.

6. An LED current balancing circuit comprising:

a first amplifier having an inverting input configured to receive a first signal that is representative of a first current through a first string of series connected LEDs, and having a non-inverting input configured to receive a second signal that is representative of a second current through a second string of series connected LEDs, the first amplifier having an output configured to form a first control signal that is representative of a difference between the first current and the second current;

a first control transistor configured to receive the first control signal and adjust the first current to be substantially equal to the second current;

a second amplifier having an inverting input configured to receive a third signal that is representative of the second current, and having a non-inverting input configured to receive the first signal or a signal that is representative of the first signal, the second amplifier having an output configured to form a second control signal that is representative of a difference between the second current and the first current;

a second control transistor configured to receive the second control signal and adjust the second current to be substantially equal to the first current; and wherein the non-inverting input of the first amplifier and the inverting input of the second amplifier are configured to receive a first dimming control signal, the inverting input of the first amplifier and the non-inverting input of the second amplifier are configured to receive a second dimming control signal wherein the first amplifier is configured to disable the first control transistor responsively to a first value of the first dimming control signal and a second value of the second dimming control signal wherein the first value and the second value or different, and wherein the second amplifier is configured to increase the second current.

7. The LED current balancing circuit of claim 6 wherein the second amplifier is configured to adjust the second current to be substantially equal to a total current received by the first and second strings of series connected LEDs.

8. The LED current balancing circuit of claim 6 wherein the second amplifier is configured to disable the second control transistor responsively to a second value of the first dimming control signal and a first value of the second dimming control signal and wherein the first amplifier is configured to increase the first current.

9. The LED current balancing circuit of claim 8 wherein the second amplifier is configured to adjust the first current to be substantially equal to a total current received by the first and second strings of series connected LEDs.

10. An LED current balancing circuit comprising:

a first amplifier having an inverting input configured to receive a first signal that is representative of a first current through a first string of series connected LEDs, and having a non-inverting input configured to receive a second signal that is representative of a second current through a second string of series connected LEDs, the first amplifier having an output configured to form a first control signal that is representative of a difference between the first current and the second current;

a first control transistor configured to receive the first control signal and adjust the first current to be substantially equal to the second current;

a second amplifier having an inverting input configured to receive a third signal that is representative of the second current, and having a non-inverting input configured to receive the first signal or a signal that is representative of the first signal, the second amplifier having an output configured to form a second control signal that is representative of a difference between the second current and the first current; and a second control transistor configured to receive the second control signal and adjust the second current to be substantially equal to the first current; and a first diode having a cathode coupled to a drain of the first control transistor and an anode, the LED current balancing circuit including a second diode coupled from the anode of the first diode to the non-inverting input of the first amplifier.

11. The LED current balancing circuit of claim 10 wherein the second diode is a portion of a bipolar transistor, wherein an emitter of the bipolar transistor is coupled to the anode of the first diode, a base of the bipolar transistor is coupled to the non-inverting input of the first amplifier, and a collector of the bipolar transistor is configured to form a fault signal.

12. An LED current balancing circuit comprising:

a first amplifier having an inverting input configured to receive a first signal that is representative of a first current through a first string of series connected LEDs, and having a non-inverting input configured to receive a second signal that is representative of a second current through a second string of series connected LEDs, the first amplifier having an output configured to form a first control signal that is representative of a difference between the first current and the second current;

a first control transistor configured to receive the first control signal and adjust the first current to be substantially equal to the second current;

a second amplifier having an inverting input configured to receive a third signal that is representative of the second current, and having a non-inverting input configured to receive a fourth signal that is representative of a third current through a third string of series connected LEDs, the second amplifier having an output configured to form a second control signal that is representative of a difference between the second current and the third current;

a second control transistor configured to receive the second control signal and adjust the second current to be substantially equal to the third current;

a third amplifier having an inverting input configured to receive a fifth signal that is representative of the third current, and having a non-inverting input configured to receive a sixth signal that is representative of a fourth current through a fourth string of series connected LEDs, the third amplifier having an output configured to form a third control signal that is representative of a difference between the third current and the fourth current; and a third control transistor configured to receive the third control signal and adjust the third current to be substantially equal to the fourth current.

13. The LED current balancing circuit of claim 12 further including a fourth amplifier having an inverting input configured to receive a seventh signal that is representative of the fourth current, and having a non-inverting input configured to receive an eighth signal that is representative of the first current, the fourth amplifier having an output configured to form a fourth control signal that is representative of a difference between the fourth current and the first current; and a fourth control transistor configured to receive the fourth control signal and adjust the fourth current to be substantially equal to the first current.

14. The LED current balancing circuit of claim 12 wherein the first amplifier is configured to disable the first control transistor responsively to a first value of a first dimming control signal and a second value of a second dimming control signal wherein the second amplifier is configured to increase the second current; and the second amplifier is configured to disable the second control transistor responsively to a first value of the second dimming control signal and a second value of the first dimming control signal wherein the second amplifier is configured to increase the first current.

15. An LED current balancing circuit comprising:

first control circuit configured to form a first current sense signal that is representative of a first current through a first string of series connected LEDs;

the first control circuit having a first input coupled to receive a second current sense signal that is representative of a second LED current through a second string of series connected LEDs;

the first control circuit configured to form a first control signal that is representative of a difference between the first current and the second current;

the first control circuit configured to drive a first transistor responsively to the first control signal to adjust a value of the first current to be substantially equal to a value of the second current;

a second control circuit configured to form the second current sense signal;

the second control circuit having a first input coupled to receive a third current sense signal that is representative of one of the first current or a third LED current through a third string of series connected LEDs;

the second control circuit configured to form a second control signal that is representative of a difference between the second current and one of the first current or the third current; and the second control circuit configured to adjust a value of the second current responsively to the second control signal to be substantially equal to one of the first current or the third current.

16. The LED current balancing circuit of claim 15 wherein the first control circuit is configured to form a first signal that is representative of an over power condition of the first string of series connected LEDs.

17. An LED current balancing circuit comprising:

first control circuit configured to form a first current sense signal that is representative of a first current through a first string of series connected LEDs;

the first control circuit having a first input coupled to receive a second current sense signal that is representative of a second LED current through a second string of series connected LEDs;

the first control circuit configured to form a first control signal that is representative of a difference between the first current and the second current;

the first control circuit configured to drive a first transistor responsively to the first control signal to adjust a value of the first current to be substantially equal to a value of the second current;

wherein the first control circuit includes a first amplifier having a non-inverting input configured to receive a first signal that is representative of the second current sense signal and an inverting input configured to receive a second signal that is representative of the first current sense signal, the amplifier having an output configured to form the first control signal; and wherein the non-inverting input of the first amplifier is configured to receive a first dimming control signal and the inverting input of the first amplifier is configured to receive a second dimming control signal wherein first amplifier is configured to disable a first control transistor responsively to a first value of the first dimming control signal and a second value of a second dimming control signal wherein the second amplifier is configured to increase the second current.

* * * * *